US010160209B2

(12) United States Patent
Chen et al.

(10) Patent No.: US 10,160,209 B2
(45) Date of Patent: Dec. 25, 2018

(54) FLEXIBLE CARRIER FOR FLUID FLOW STRUCTURE

(71) Applicant: HEWLETT-PACKARD DEVELOPMENT COMPANY, L.P., Houston, TX (US)

(72) Inventors: Chien-Hua Chen, Corvallis, OR (US); Michael G. Groh, Albany, OR (US); Michael W. Cumbie, Albany, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/113,520

(22) PCT Filed: Jan. 28, 2014

(86) PCT No.: PCT/US2014/013309
§ 371 (c)(1),
(2) Date: Jul. 22, 2016

(87) PCT Pub. No.: WO2015/116025
PCT Pub. Date: Aug. 6, 2015

(65) Prior Publication Data
US 2017/0072690 A1 Mar. 16, 2017

(51) Int. Cl.
*B41J 2/14* (2006.01)
*B41J 2/16* (2006.01)

(52) U.S. Cl.
CPC ..... *B41J 2/1433* (2013.01); *B41J 2/1601* (2013.01); *B41J 2/1623* (2013.01); *B41J 2/1637* (2013.01); *B41J 2002/14491* (2013.01)

(58) Field of Classification Search
CPC ..... B41J 2/1433; B41J 2/1623; B41J 2/1637; B41J 2/1601; B41J 2002/14491
See application file for complete search history.

(56) References Cited

U.S. PATENT DOCUMENTS 4,678,529 A * 7/1987 Drake ..... B41J 2/1604 156/234
6,270,182 B1 8/2001 Silverbrook et al.
7,969,026 B2 6/2011 Lytle et al.
(Continued)

FOREIGN PATENT DOCUMENTS

CN 1201359 12/1998
CN 1259085 7/2000
(Continued)

OTHER PUBLICATIONS

Peter C. Salmon, Chip-on-flex with 5-micron Features, Proc. SPIE 4979. Micromachining and Microfabrication Process Technology VIII, 295, Jan. 25, 2003.

*Primary Examiner* — Henok Legesse
(74) *Attorney, Agent, or Firm* — HP Inc.—Patent Department

(57) ABSTRACT

An example system includes a flexible carrier and a printhead flow structure. The printhead flow structure includes a flex circuit including a carrier wafer and at least one printhead die electrically coupled to the flex circuit. The carrier wafer is bonded to the flexible carrier with thermal release tape, the thermal release tape to debond substantially completely from the flex circuit at a debonding temperature via bending of the flexible carrier.

9 Claims, 9 Drawing Sheets

(56) References Cited

U.S. PATENT DOCUMENTS

| | | | |
|---|---|---|---|
| 8,337,657 | B1 | 12/2012 | Dunla et al. |
| 8,587,123 | B2 | 11/2013 | Law et al. |
| 2006/0012020 | A1 | 1/2006 | Gilleo et al. |
| 2006/0022273 | A1 | 2/2006 | Halk |
| 2009/0225131 | A1* | 9/2009 | Chen ..... B41J 2/14145 347/44 |
| 2010/0224983 | A1 | 9/2010 | Huang et al. |
| 2011/0037808 | A1 | 2/2011 | Ciminelli et al. |
| 2013/0048224 | A1 | 2/2013 | George et al. |
| 2014/0020847 | A1 | 1/2014 | Burggraf et al. |

FOREIGN PATENT DOCUMENTS

| | | |
|---|---|---|
| CN | 1286172 | 3/2001 |
| CN | 101663165 | 3/2010 |
| CN | 102460677 | 5/2012 |
| CN | 102470672 | 5/2012 |
| EP | 1080907 | 3/2001 |
| JP | 2003291340 | 10/2003 |
| JP | 2011219568 | 11/2011 |
| WO | WO2014/133517 | 9/2014 |

* cited by examiner

FLEXIBLE CARRIER FOR FLUID FLOW STRUCTURE

BACKGROUND

Printing devices are widely used and may a printhead die enabling formation of text or images on a print medium. Such a printhead die may be included in an inkjet pen or print bar that includes channels that carry ink. For instance, ink may distributed from an ink supply to the channels through passages in a structure that supports the printhead die(s) on the inkjet pen or print bar

DETAILED DESCRIPTION

Figure 1:
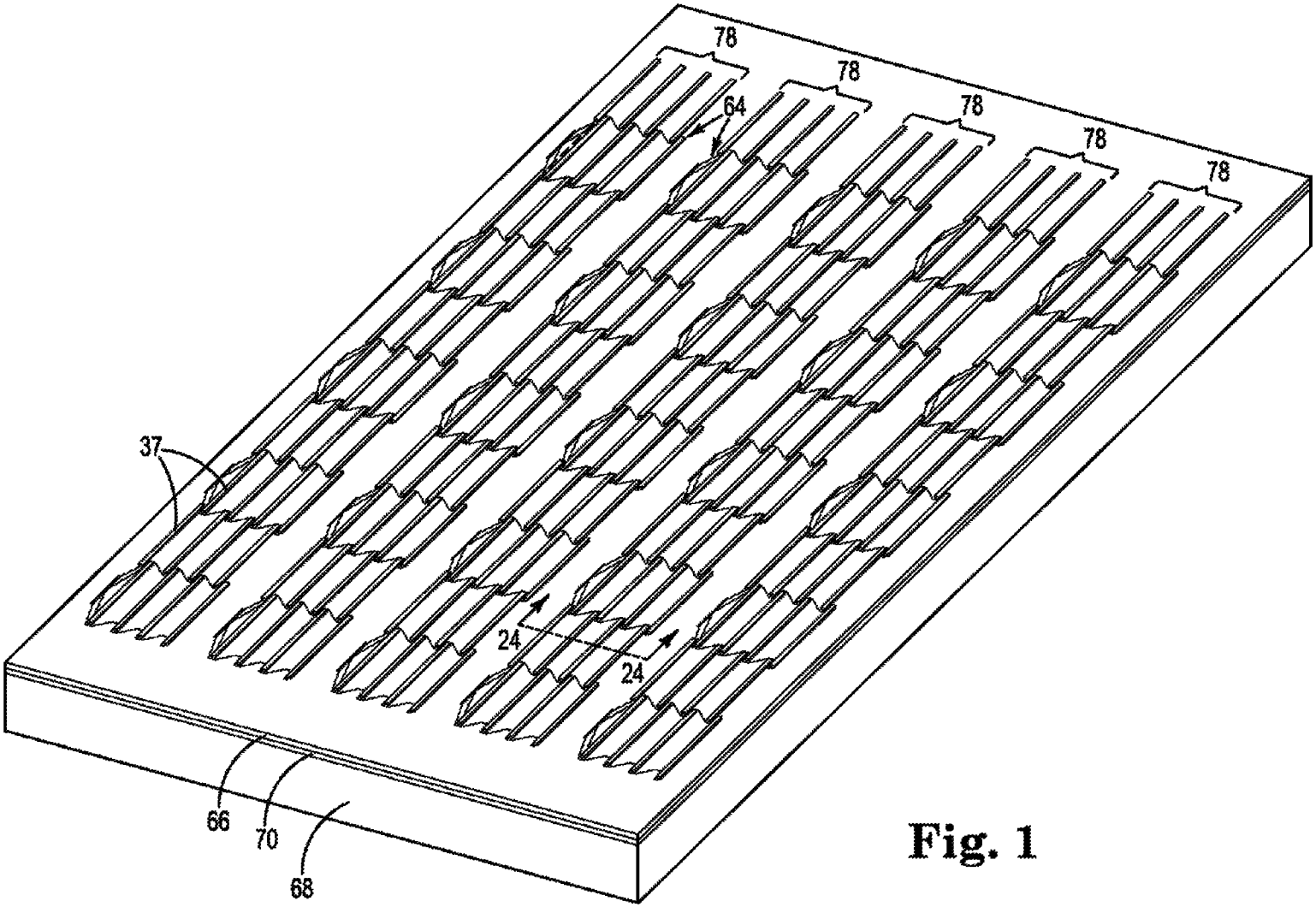
FIGS. 1-6 illustrate perspective views illustrating an example of a wafer level system including a flexible carrier for making a printhead flow structure according to the present disclosure.

Inkjet printers that utilize a substrate wide print bar assembly have been developed to help increase printing speeds and reduce printing costs. Conventional substrate wide print bar assemblies include multiple parts that carry printing fluid from the printing fluid supplies to the small printhead dies from which the printing fluid is ejected on to the paper or other print substrate. It may be desirable to shrink the size of a printhead die, however, decreasing the size of a printhead die can require changes to the structures that support the printhead die, including the passages that distribute ink to the printhead die. While reducing the size and spacing of the printhead dies continues to be important for reducing cost, channeling printing fluid from supply components to tightly spaced dies may in turn lead to comparatively complex flow structures and fabrication processes that can actually increase an overall cost associated with a printhead die. Forming such complex flow structures may itself involve use of difficult processes and/or additional materials such as adhesives (e.g., thermal release tape including an adhesive). Such formation methods may prove costly, ineffective, and/or difficult (time-consuming) to perform, among other shortcomings.

In contrast, examples of the present disclosure include a flexible carrier (i.e., a flexible carrier board) along with a system and a method including the flexible carrier. The systems and methods including the flexible carrier can form a fluid flow structure having desirable (e.g., compact printhead dies and/or compact die circuitry to help reduce cost in substrate wide inkjet printers) features. A flexible carrier refers to a carrier of a suitable material that can bend, enable a flex circuit (e.g., a carrier wafer included in a flex circuit) and/or a thin composite material, for instance, a composite material composed of woven fiberglass cloth with an epoxy resin binder (e.g., FR4 board) to be bonded thereto, and promote debonding of the flex circuit, as described herein. For example, a thin wafer can be bonded to the flexible carrier and/or subsequently debonded, for instance, debonded (e.g., released) after forming a fluid printhead flow structure, as described herein.

In various examples, the flexible carrier can include an elastomer material. For instance, the flexible carrier 68 can include a body, where at least a portion of the body includes an elastomer material that bends along a length of the flexible carrier 68 when debonding a flex circuit or a thin FR4 board, as described herein, from a surface of the flexible carrier 68 and returns to its original shape when the flex circuit is debonded. In contrast to various other non-flexible carriers (e.g., glass carriers, metal carriers, etc.), such properties advantageously enable the flexible carrier 68 to be reused, for instance, to make a plurality of printhead flow structures.

Moreover, use of a flexible carrier can advantageously enable comparatively higher molding temperatures (e.g., molding at 150° Celsius (C) rather than 130° C.) and/or comparatively shorter molding times. As such, costs (e.g., energy, materials, and/or time costs, among others) traditionally associated with adhesives, such as heating a thermal release tape to or above a release temperature of the tape are advantageously avoided by the present disclosure. For example, debonding, as described herein, can occur at about ambient temperature (i.e., 21° C.) in contrast to a comparatively elevated temperature (e.g., 180° C. for thermal release tape with 170° C. rating).

Figure 5:
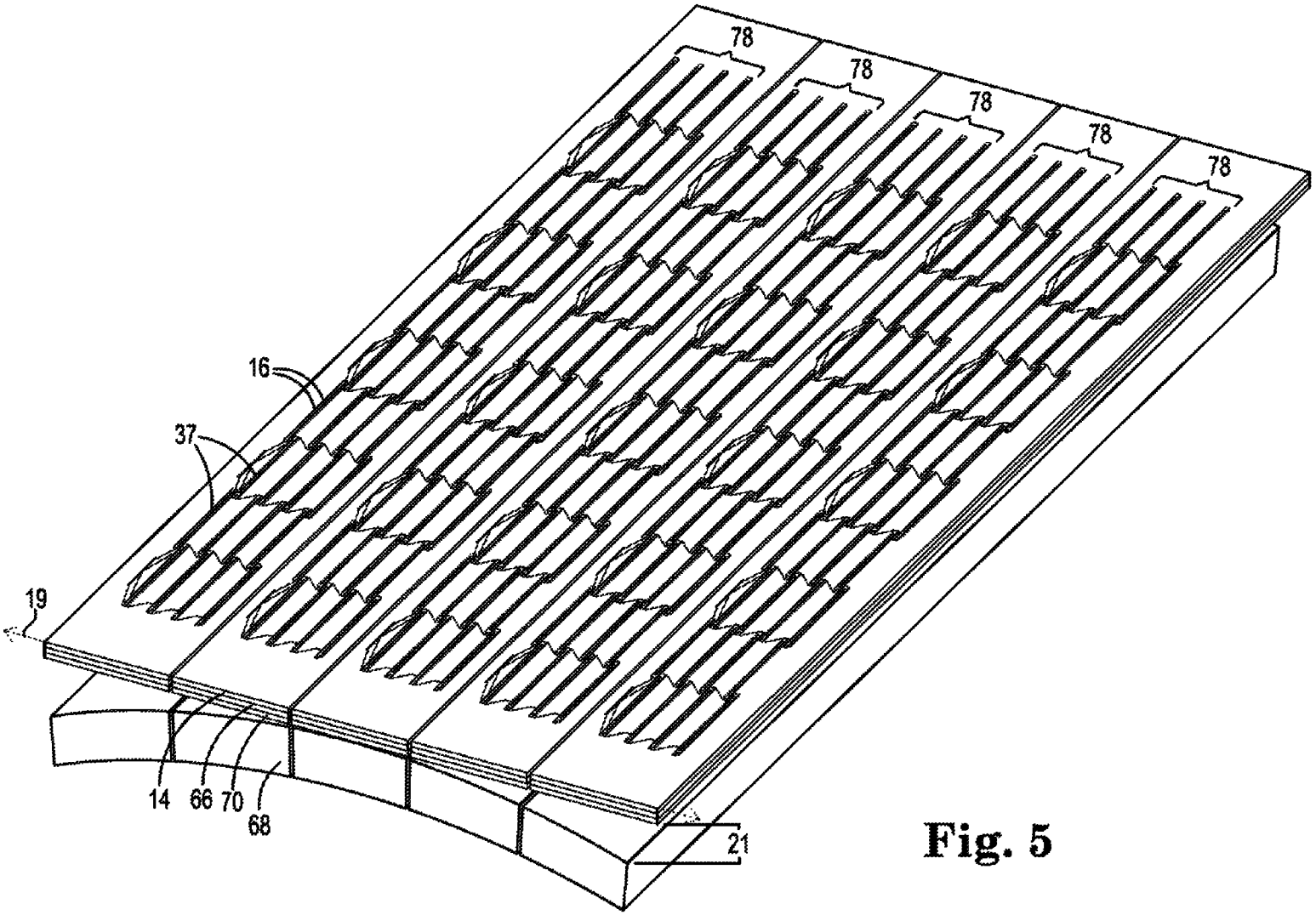
Figure 6:
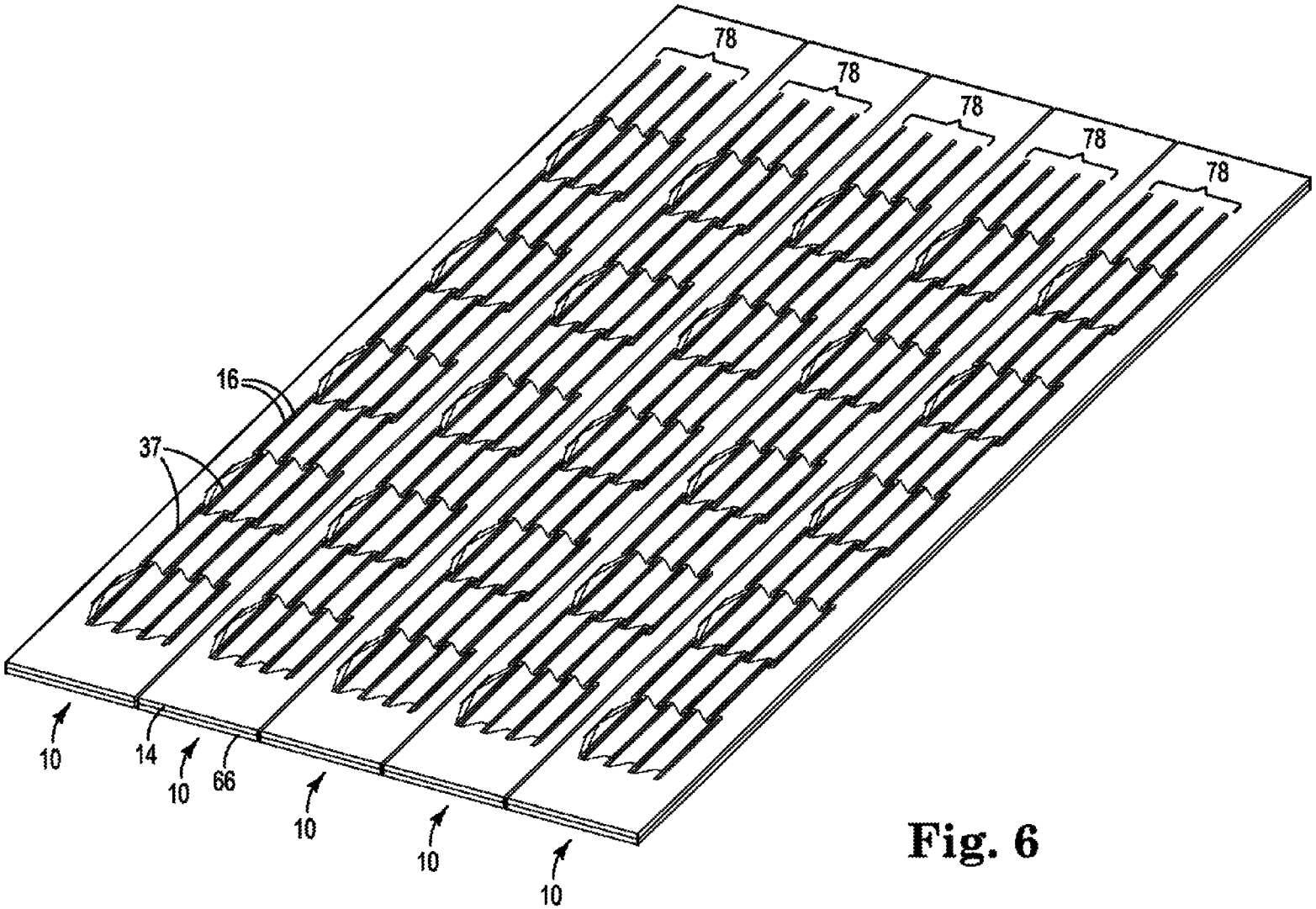
Figure 7:
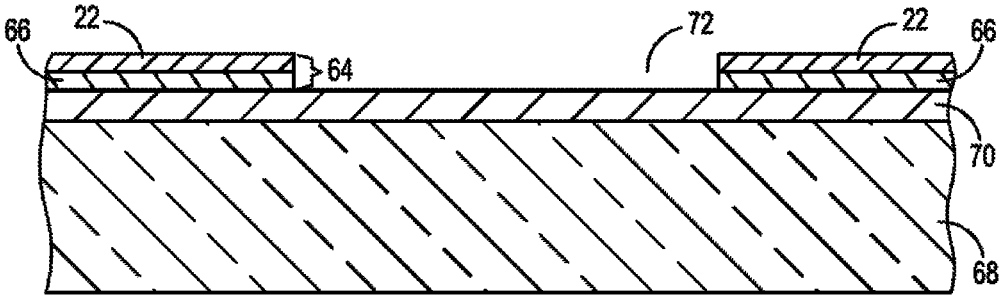
FIGS. 7-11 are section views illustrating an example of a method including a flexible carrier according to the present disclosure.

FIGS. 1-6 illustrate perspective views illustrating an example of a wafer level system including a flexible carrier for making a printhead flow structure according to the present disclosure. An example of a system can include a flexible carrier 68, a flex circuit 64 including a carrier wafer 66, and a printhead flow structure (e.g., a printhead flow structure 10 as illustrated in FIG. 6). FIG. 1 illustrates that printheads 37 can be placed on a glass or other suitable carrier wafer 66 with a thermal release tape 70 in a pattern of multiple print bars. Although a "wafer" is sometimes used to denote a round substrate while a "panel" is used to denote a rectangular substrate, a "wafer" as used in this document includes any shape substrate. Printheads 37 can be placed on to the flexible carrier with thermal release tape 70 after first applying or forming a pattern of conductors 22, such as conductors included in a FR4 board, and die openings 72 (e.g., as illustrated in FIG. 7).

Specifically, FIG. 1 illustrates five sets of dies 78 each having four rows of printheads 37 are laid out on carrier wafer 66 to form five print bars. A substrate wide print bar for printing on Letter or A4 size substrates with four rows of printheads 37, for example, is about 230 mm long and 16 mm wide. Thus, five die sets 78 may be laid out on a single 270 mm×90 mm carrier wafer 66 as shown in FIG. 1. However, the present disclosure is not so limited. That is, the size, number, and orientation of the printheads 37, carrier wafer 66, and/or print bars, among other features, may vary.

Figure 2:
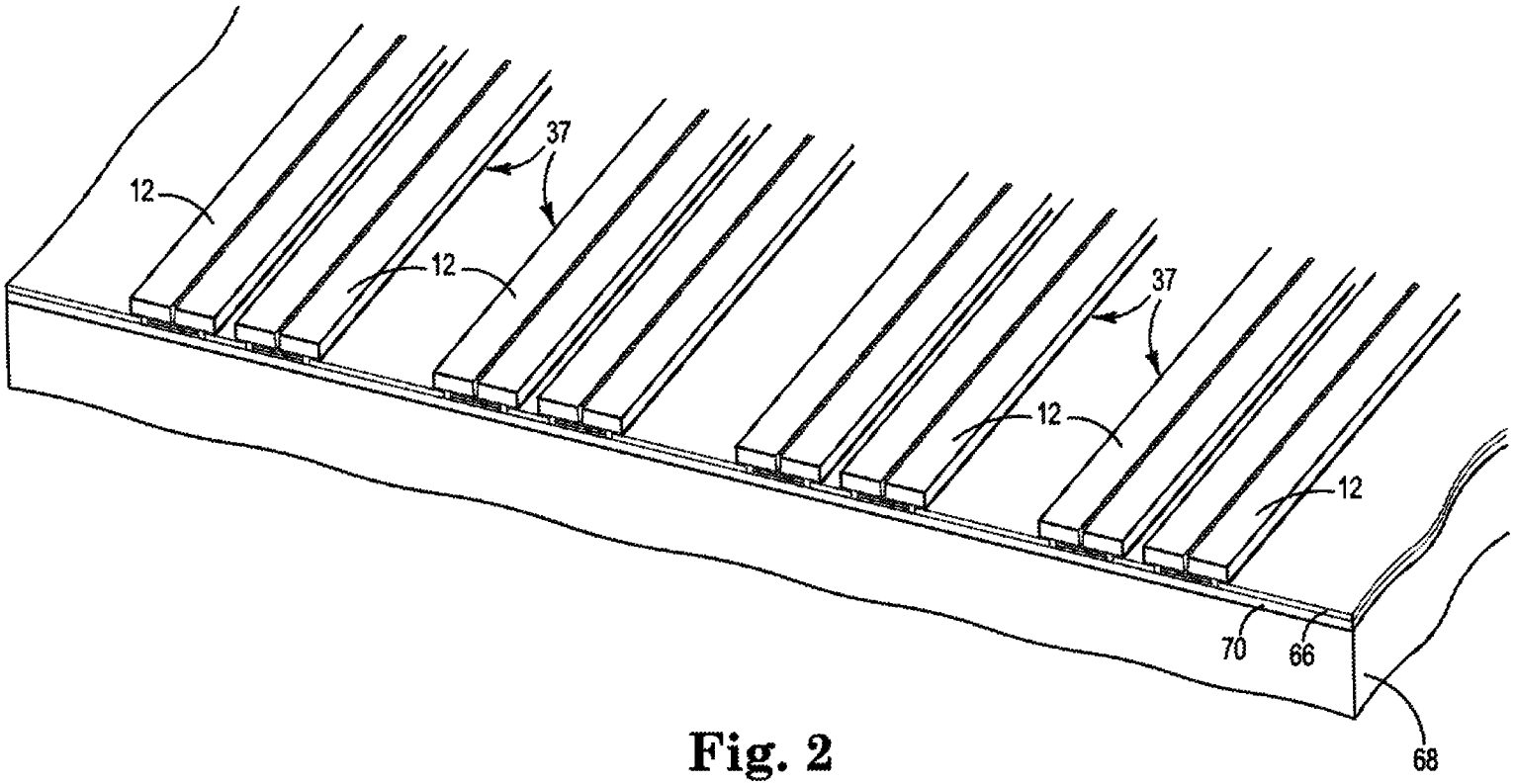
Figure 3:
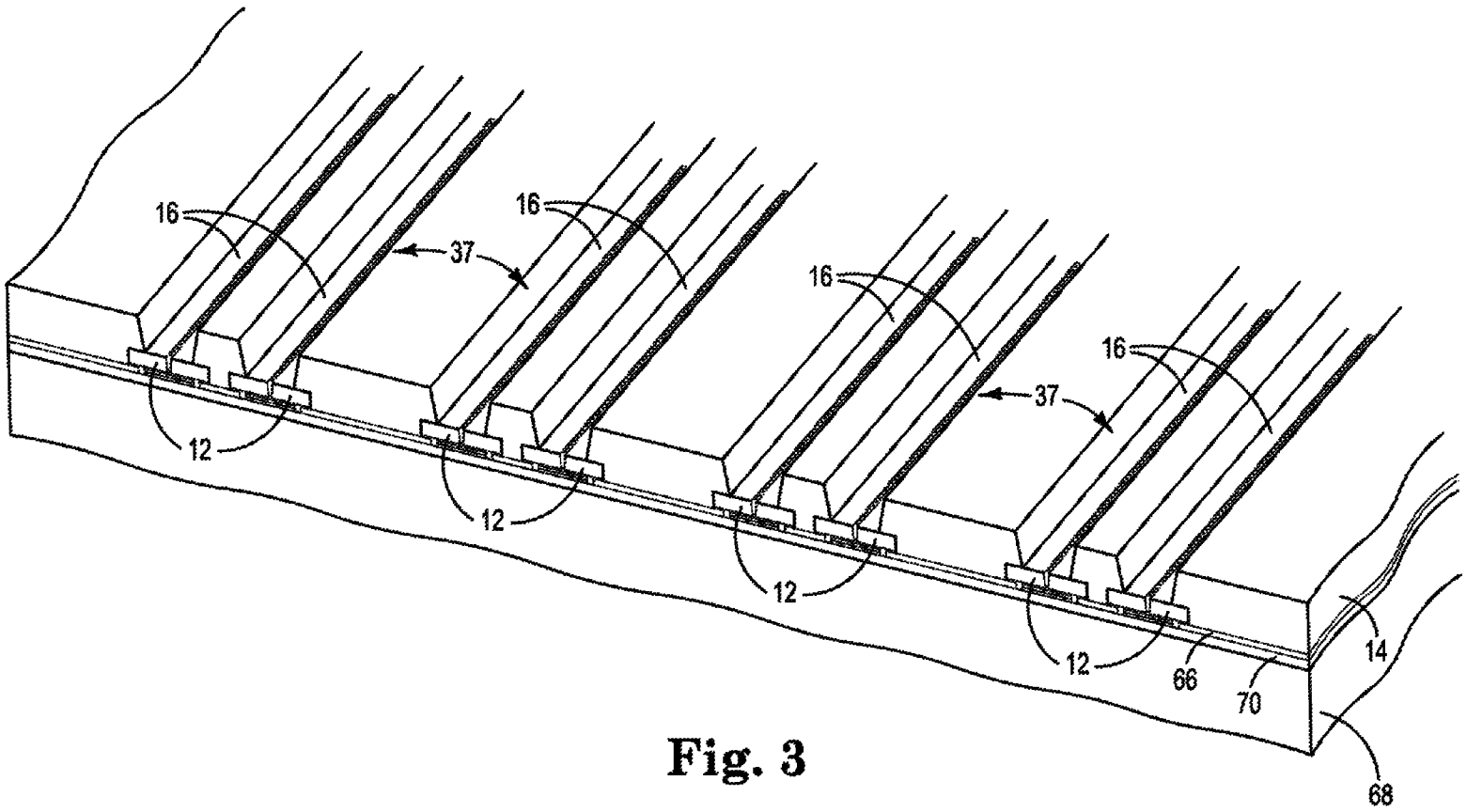
Figure 4:
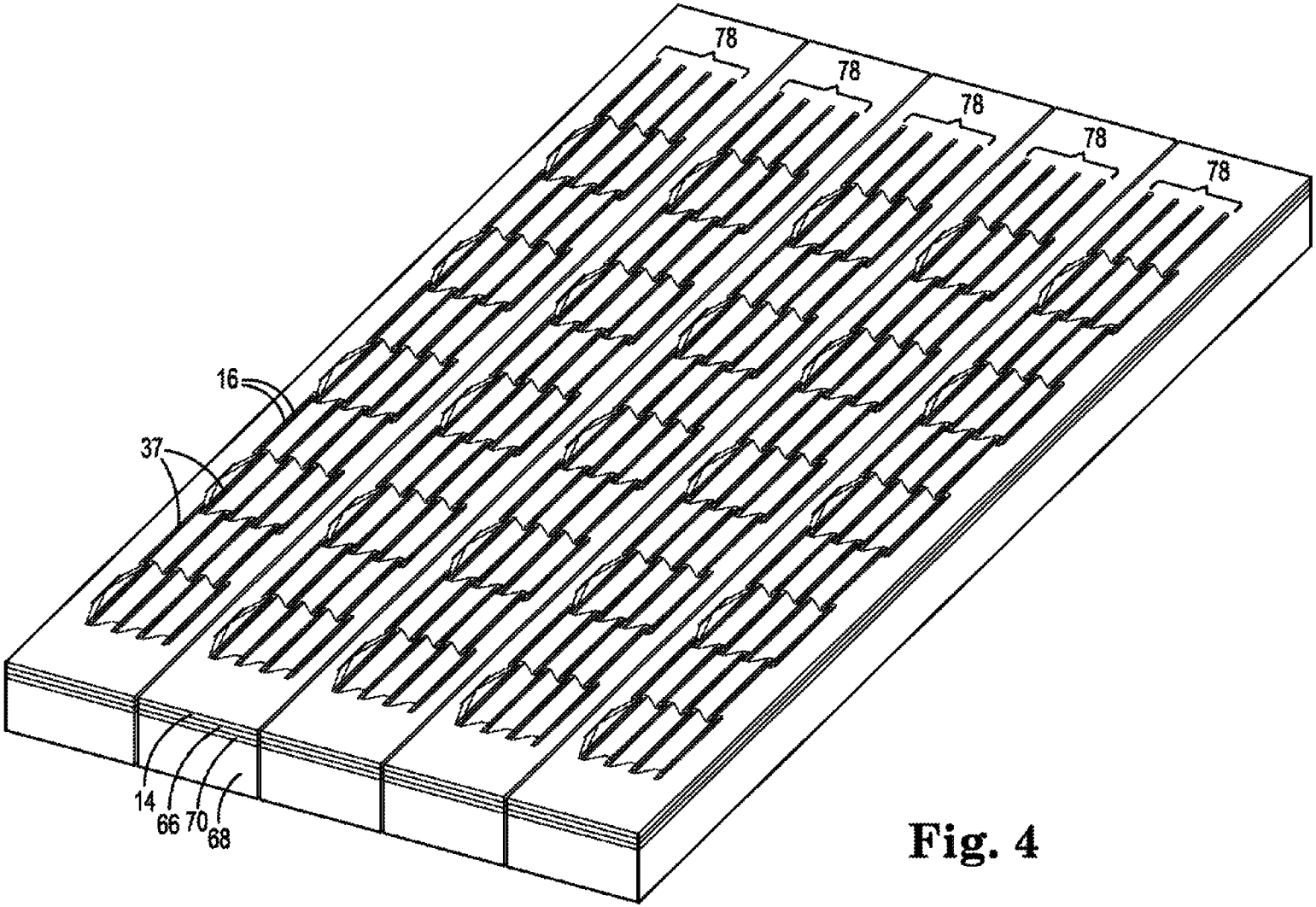

FIG. 2 is a close-up section view of one set of four rows of printheads 37 taken along the line 24-24 in FIG. 1. Cross hatching is omitted for clarity. FIGS. 1 and 2 show an in-process wafer structure after the completion of 102-104 as described with respect to FIG. 12. FIG. 3 shows the section of FIG. 2 after molding as described at 106 in FIG. 12 in which molding (e.g., molded body) 14 with channels 16 is molded around printhead dies 12. Individual print bar strips 78 are separated in FIG. 4 and debonded (e.g., released) from the flexible carrier 68 as illustrated in FIG. 5 to form five individual print bars 36 (108 in FIG. 12) illustrated in FIG. 5.

Debonding, as described herein, utilizes the flexible carrier 68. For example, debonding can include flexing the flexible carrier 68 to debond (e.g., physically separate) the printhead flow structure from the flexible carrier. In some examples, debonding can include flexing the flexible carrier 68 in at least a direction perpendicular to a bonding axis, such as bonding axis 19 illustrated in FIG. 5. However, the present disclosure is not so limited. That is, the flexible carrier 68 can bend in any suitable direction and/or combination of directions to promote debonding (e.g., sufficient to debond the printhead flow structure from the flexible carrier 68). Advantageously, use of a flexible carrier can, in some examples, enable debonding at a temperature (e.g., 150° C.) of at least 15° C. below a rated temperature of a thermal release tape (e.g., a thermal release tape rated as having a release temperature at 200° C.). That is, debonding can include debonding a printhead flow structure from the flexible carrier at a temperature below a release temperature of the thermal release tape, for instance, by flexing the flexible carrier. A release temperature refers to a temperature at which the thermal release tape is designed to release (e.g., experience a substantial reduction in its adhesive properties).

In some examples, the flexible carrier 68 can include an elastomer. The elastomer can include an epoxy, among other components. For example, a flexible carrier 68 can include cured epoxy composition and/or high temperature plastic(s). In some examples, the cured epoxy composition can include particulate matter and/or structures (e.g., fiberglass structures, electrical circuits, etc.) embedded in the at least one epoxy, such as FR4 board.

Such an elastomer can allow the flexible carrier 68 to bend (e.g., with respect to a bonding axis) in response to a strain and return to its original position and original shape when the strain is removed. Such a return to an original position can occur without requiring a change of temperature (e.g., return to an original position without heating the flexible carrier 68). An amount of bending can correspond to an amount of bending suitable for debonding, as described herein. For instance, in some examples, the flexible carrier 68 can bend to debond a carrier wafer 66 included in a flex circuit from the flexible carrier 68 and/or return to its original shape when the flex circuit is debonded from the flexible carrier 68. Advantageously, this can promote reuse of the flexible carrier 68, for example, reusing the flexible carrier 68 to make another printhead flow structure (e.g., in addition to a previously formed printhead flow structure formed using the flexible carrier 68).

Moreover, for a panel level compression molding application with a rigid carrier, a maximum molding temperature (e.g., 130 C.°) is limited by a rating of a thermal release tape (e.g., a thermal release tape having a release temperature of 170 C.°) to maintain a proper adhesion during the molding process. In such an application, the whole assembly is heated to or above 170 C.° to debond the flex circuit. Such heating can be time consuming and/or costly, among other disadvantages. On the contrary, a flexible carrier 68 allows use of a high temperature release tape (e.g., a thermal release tape having a 200 C.° release temperature), molding at higher temperatures (e.g., 150 C.°), reduced cycle time, and still enables debonding of the flex circuit from a flexible carrier at much lower temperature (e.g., a temperature below 100 C.°) compared to panel level compression molding application with a rigid carrier.

An amount of bending of an elastomer material can be determined by a force (not shown) applied to the elastomer material and/or a type of the elastomer material, among other factors. Such a force can cause the flexible carrier 68 to bend to a bent position (e.g., as illustrated in FIG. 5 by flexible carrier 68 as shown by a bend 21 in the flexible carrier with respect to axis 19). Such bending can prevent the flexible carrier 68 from breaking and/or promote debonding, as described herein, among other advantages. Some examples allow the flexible carrier 68 to bend in a range between 5 and 10 degrees, for example, with respect to a bonding axis, herein. However, the present disclosure is not so limited. That is, the flexible carrier 68 can bend a suitable number degrees and/or directions to promote debonding, as described herein.

In some examples, a flexible carrier 68 can include substantially rigid material having portions of the rigid material selectively removed to enable the flexible carrier 68 to bend (e.g., similar to bending associated with an elastomer, as described herein). For example, selective removal may include a pattern of material removed from the substantially rigid material, for instance, by laser ablation and/or mechanical die cutting, among other suitable removal technologies. That is, a resulting flexible portion may be defined by a geometric pattern that may be recessed and/or cut into the rigid material. Substantially rigid material as used herein is meant to encompass rigid materials, semi-rigid (partially flexible materials), and substantially any materials where an increased flexibility may be desired. For example, the rigid material may be metal, carbon fiber, composites, ceramics, glass, sapphire, plastic, or the like. The flexible portion or portions defined in the rigid material may function as a hinge (e.g., mechanical hinge) and/or allow the rigid material to bend to a predetermined angle in a predetermined direction. In some embodiments, the flexible portion may be positioned at substantially any location of the rigid material and may span across one or more dimensions of the rigid material (e.g., across a width, length, or height of the rigid material). In some instances, the rigid material may be substantially flat or planar, may represent a three-dimensional object (e.g., a molded or machined component), or the like.

Figure 11:
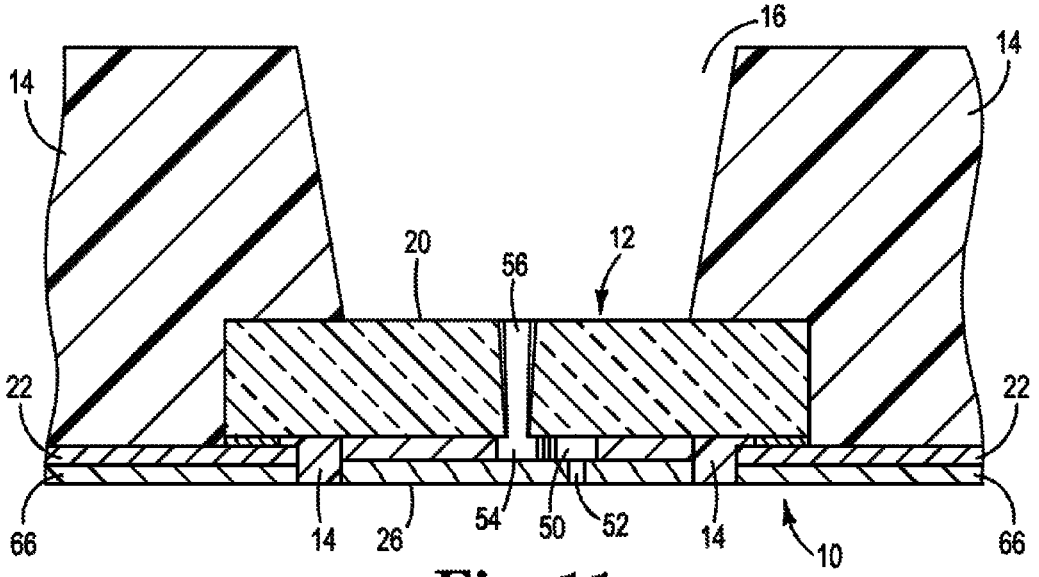

While any suitable molding technology may be used, wafer level systems including wafer level molding tools and techniques currently used for semiconductor device packaging may be adapted cost effectively to the fabrication of a printhead flow structure 10 such as those shown in FIGS. 6 and 11. Advantageously, the molding 14, in some examples, does not include a release agent. A release agent refers to a chemical(s) added to the molding 14 (e.g., added to the molding 14 during molding thereof) that promotes release of the molding 14. Examples of release agents can include barrier release agents, reactive release agents, and/or water-based release agents, among other release agents.

A stiffness (e.g., amount of flex in response to forces imparted on the molding 14 during and/or after molding) of the molding 14 can be adjusted depending upon the desired features of the molding. A comparatively stiffer molding 14 may be used where a comparatively rigid (or at least less flexible) print bar 36 is desired, for instance, to hold printhead dies 12 in a desired position (e.g., a desired plane with respect to a media surface). A comparatively less stiff molding 14 can be used where a comparatively flexible print bar 36 is desired, for example where another support structure holds the print bar rigidly in a single plane or where a non-planar print bar configuration is desired. In some examples, molding 14 can be molded as a monolithic part, however, molding 14 can, in some examples, be molded as more than one part.

For example, a print bar can include multiple printhead dies 12 molded into an elongated, monolithic body 14 of moldable material made by devices, systems, and/or methods described herein. Printing fluid channels molded into the body 14 can carry printing fluid directly to printing fluid flow passages in each die. The molding 14 in effect grows the size of each die for making external fluid connections and for attaching the dies to other structures, thus enabling the use of smaller dies. The printhead dies 12 and printing fluid channels can be molded at the wafer level to make a composite printhead wafer with built-in printing fluid channels, eliminating the need to form the printing fluid channels in a silicon substrate and enabling the use of thinner dies. Advantageously, forming the fluid flow structure using a flexible carrier 68, as described herein, can promote improved die separation ratio, eliminate silicon slotting cost, eliminate fan-out chiclets, among other advantages.

The fluid flow structure can include, but is not limited to, print bars or other types of printhead structures for inkjet printing. The fluid flow structure can be implemented in other devices and for other fluid flow applications. Thus, in one example, the fluid flow structure includes a micro device embedded in a molding 14 having a channel or other path for fluid to flow directly into or onto the device. The micro device, for example, can be an electronic device, a mechanical device, or a microelectromechanical system (MEMS) device. The fluid flow, for example, can be a cooling fluid flow into or onto the micro device or fluid flow into a printhead die 12 or other fluid dispensing micro device.

FIGS. 7-11 are section views illustrating an example of a method including a flexible carrier 68 according to the present disclosure. A flex circuit 64 with conductors 22 and carrier wafer 66 can be bonded (e.g., laminated on) to a flexible carrier 68 with thermal release tape 70. Conductors can extend to bond pads (not shown) near the edge of each row of printheads. (The bond pads and conductive signal traces, such as those to individual ejection chambers or groups of ejection chambers are omitted to not obscure other structural features.) Such bonding can include bonding a flex circuit to a flexible carrier with a thermal release tape 70, or otherwise applied to the flexible carrier 68 (102 in FIG. 12). Advantageously, bonding without adhesive can promote subsequent debonding, as described herein.

Figure 8:
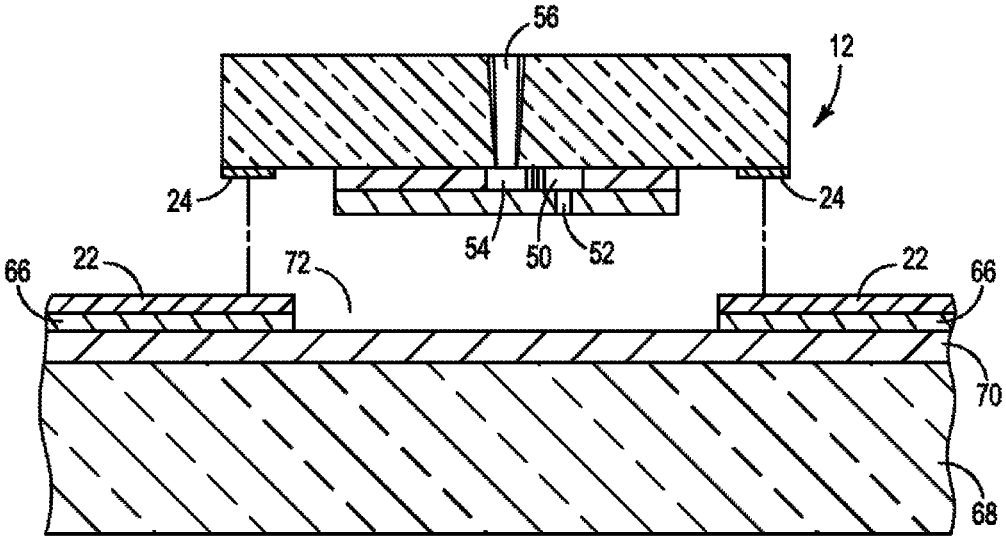
Figure 9:
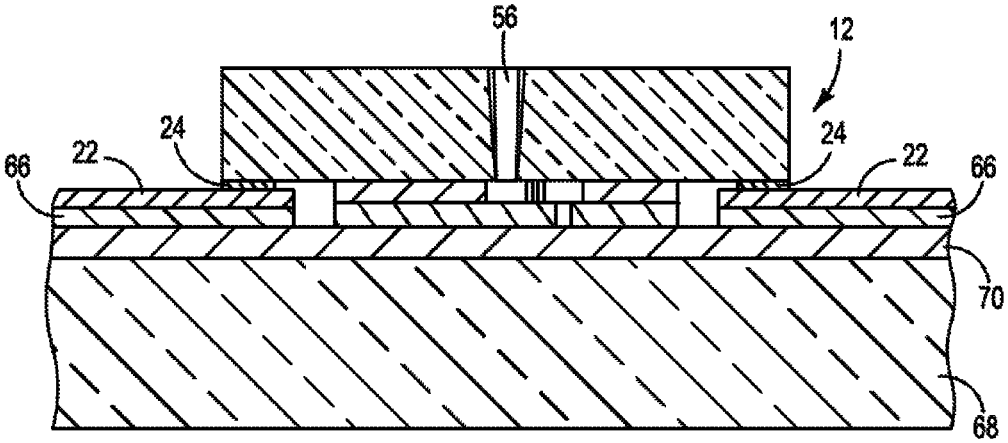
Figure 10:
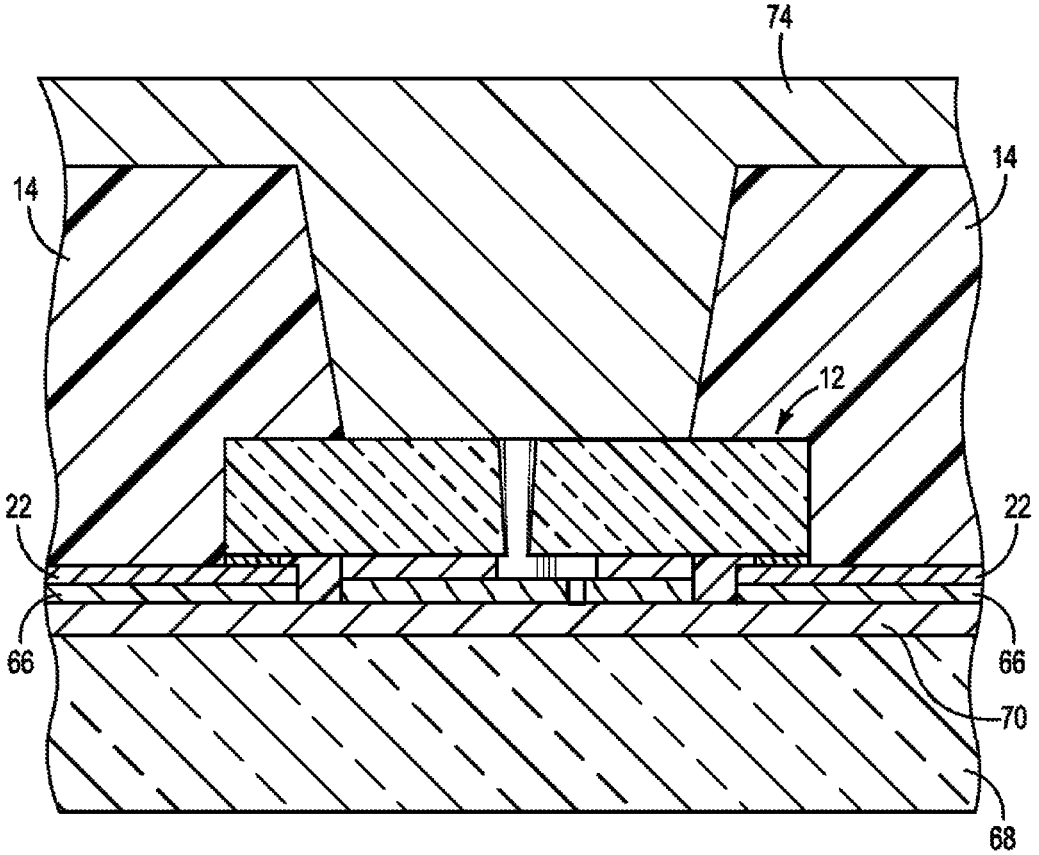

As shown in FIGS. 8 and 9, printhead die 12 can be placed in opening 72 on the flexible carrier 68 (104 in FIG. 12) and conductor(s) 22 can be coupled to an electrical terminal 24 on die 12. For example, printhead die 12 can be placed orifice side down in opening 72 on the flexible carrier 68. In FIG. 10, a molding tool 74 forms printing fluid supply channels 16 in a molding 14 around printhead die 12 (106 in FIG. 12). A tapered printing fluid supply channel 16, such as those described herein, may be desirable in some applications to facilitate the release of molding tool 74 and/or increase fan-out.

In a transfer molding process, such as that shown in FIG. 11, printing fluid supply channels 16 can be molded into a molding (e.g., molded body) 14. For example, printing fluid supply channels 16 can be molded in a body 14 along each side of printhead die 12, using a transfer molding process such as that described above with reference to FIGS. 7-11. Printing fluid flows from printing fluid supply channels 16 through ports 56 laterally into each ejection chamber 50 directly from channels 16. In some examples, an orifice plate (not shown) and/or a cover (not shown) can be applied after molding the body 14 to close printing fluid supply channels 16. For instance, a discrete cover partially defining channels 16 can be used, however, an integrated cover molded into body 14 could also be used, among other possible covers and/or orifice plates to close (e.g. partially close) the printing fluid supply channels 16.

In an example, flow path including the printing fluid supply channels 16 in molding 14 allows air or other fluid to flow along an exterior surface 20 of micro device (not shown), for instance to cool device 12. Also, in this example, signal traces or other conductors 22 connected to device 12 at electrical terminals 24 can be molded into body 14. In another example, micro device (not shown) can be molded into body 14 with an exposed surface 26 opposite printing fluid supply channel 16. In another example, micro devices (not shown) can be molded into body 14 as an outboard micro device and an inboard micro device each having respective fluid flow channels leading thereto. In this example, flow channels can contact the edges of an outboard micro device while flow channel contacts the bottom of an inboard device.

In other fabrication processes, it may be desirable to form printing fluid supply channels 16 after molding body 14 around printhead die 12. While the molding of a single printhead die 12 and printing fluid supply channel 16 is shown in FIGS. 7-11, multiple printhead dies 12 and printing fluid supply channel 16 can be molded simultaneously at the wafer level.

In response to molding (e.g., after molding), printhead flow structure 10 is debonded, as described herein, from the flexible carrier 68 (108 in FIG. 12) to form the completed printhead flow structure shown in FIG. 11 in which conductor 22 can be covered by carrier wafer 66 and surrounded by molding 14. Printhead flow structure 10 includes a micro device, similar or analogous to a single printhead 12, molded into in a monolithic body 14 of plastic or other moldable material. A molded body 14 can be also referred to herein as a molding 14 and/or a body 14. Micro device, for example, can be an electronic device, a mechanical device, or a microelectromechanical system (MEMS) device. A channel 16 or other suitable fluid flow path 16 can be molded into body 14 in contact with micro device so that fluid in printing fluid supply channel 16 can flow directly into or onto micro device (or both). In this example, printing fluid supply channel 16 can be connected to fluid flow passages 18 in micro device and exposed to exterior surface 20 of micro device.

Printheads 37 can be embedded in an elongated, monolithic body 14 and arranged generally end to end, along a length of the monolithic body, in rows 48 in a staggered configuration in which the printheads 37 in each row overlap another printhead in that row. Although four rows of staggered printheads 37 are shown in various Figures including FIG. 6, for printing four different colors for example, other suitable configurations are possible.

An individual print bar, such as those described with respect to FIG. 6 can be included in a printer (not shown). For example, a printer can include print bar 36 spanning the width of a print substrate 38, flow regulators 40 associated with print bar 36, a substrate transport mechanism 42, ink or other printing fluid supplies 44, and a printer controller 46. Controller 46 represents the programming, processor(s) and associated memories, and the electronic circuitry and components to control the operative elements of a printer (not shown). Print bar 36 includes an arrangement of printheads 37 for dispensing printing fluid on to a sheet or continuous web of paper or other print substrate 38. As described in detail below, each printhead 37 includes one or more printhead dies 12 in a molding 14 with printing fluid supply channels 16 to feed printing fluid directly to the die(s). Each printhead die 12 receives printing fluid through a flow path from supplies 44 into and through flow regulators 40 and printing fluid supply channels 16 in print bar 36.

A fluid source (not shown) can be operatively connected to a fluid mover (not shown) configured to move fluid to channels (e.g., a flow path) 16 in printhead flow structure 10. A fluid source may include, for example, the atmosphere as a source of air to cool an electronic micro device or a printing fluid supply for a printhead micro device. Fluid mover represents a pump, a fan, gravity or any other suitable mechanism for moving fluid from source to printhead flow structure 10.

Printing fluid flows into each ejection chamber 50 from a manifold 54 extending lengthwise along each die 12 between the two rows of ejection chambers 50. Printing fluid feeds into manifold 54 through multiple ports 56 that can be connected to a printing fluid supply channel(s) 16 at die surface 20. Printing fluid supply channel 16 can be substantially wider than printing fluid ports 56 to carry printing fluid from larger, loosely spaced passages in the flow regulator or other parts that carry printing fluid into print bar 36 to the smaller, tightly spaced printing fluid ports 56 in printhead die 12. Thus, printing fluid supply channels 16 can help reduce or even eliminate the need for a discrete "fan-out" and other fluid routing structures necessary in some conventional printheads. In addition, exposing a substantial area of printhead die 12 surface 20 directly to printing fluid supply channel 16, as shown, allows printing fluid in printing fluid supply channel 16 to help cool die 12 during printing.

A printhead die 12 can include multiple layers, for example, three layers (not shown) respectively including ejection chambers 50, orifices 52, manifold 54, and ports 56, as illustrated in FIG. 8. However, a printhead die 12 can include a complex integrated circuit (IC) structure formed on a silicon substrate 58 with layers and/or elements not illustrated herein. For example, a thermal ejector element or a piezoelectric ejector element can be formed on a substrate (not shown) at each ejection chamber 50 and/or can be actuated to eject drops or streams of ink or other printing fluid from orifices 52.

A molded printhead flow structure 10 enables the use of long, narrow and very thin printhead dies 12. For example, it has been shown that a 100 μm thick printhead die 12 that can be about 26 mm long and 500 μm wide can be molded into a 500 μm thick body 14 to replace a conventional 500 μm thick silicon printhead die. It may be advantageous (e.g., cost effective, etc.) to mold printing fluid supply channel(s) 16 into body 14 compared to forming the fluid supply channels 16 in a silicon substrate, while additional advantages may be realized by forming printing fluid ports 56 in a thinner die 12. For example, ports 56 in a 100 μm thick printhead die 12 may be formed by dry etching and other suitable micromachining techniques not practical for thicker substrates. Micromachining a high density array of straight or slightly tapered through ports 56 in a thin silicon, glass or other substrate 58 rather than forming conventional slots leaves a stronger substrate while still providing adequate printing fluid flow. Tapered ports 56 help move air bubbles away from manifold 54 and ejection chambers 50 formed, for example, in a monolithic or multi-layered orifice plate 60/62 applied to substrate 58. In some examples, molded printhead dies 12 can as thin as 50 μm, with a length/width ratio up to 150, and to mold printing fluid supply channels 16 as narrow as 30 μm.

Figure 12:
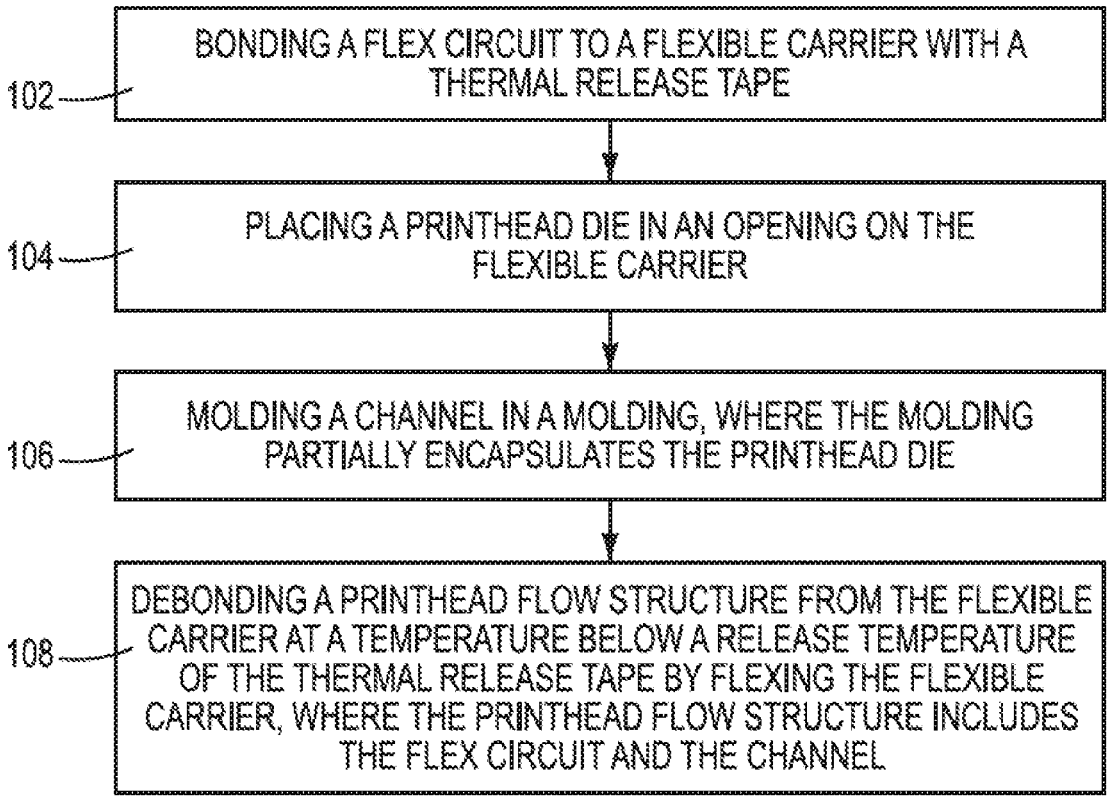
FIG. 12 is an example flow diagram of an example of a process including a flexible carrier according to the present disclosure.

FIG. 12 is an example flow diagram of an example of a process including a flexible carrier 68 according to the present disclosure, for example, a flexible carrier 68 as described with respect to FIGS. 7-11. As shown at 102, the method can include bonding a flex circuit to a flexible carrier 68. For example, bonding can include bonding a flex circuit to a flexible carrier 68 with thermal release tape. The flexible carrier allows molding at higher temperature (with high temperature thermal release tape) while debonding the flex circuit at low temperature (much below the thermal release temperature rating).

The method can include placing a printhead die in an opening on the flexible carrier 68, as illustrated at 104. Placing can include placing a printhead die 12 orifice side down in opening 72 on the flexible carrier 68.

As illustrated at 106, the method can include molding a printing fluid supply channel 16 in a molding 14, for instance, where the molding 14 partially encapsulates the printhead die 12. In some examples, printing fluid supply channel 16 can be molded in body 14 along each side of printhead die 12, for example, using a transfer molding process such as that described above with reference to FIGS. 6-10. Printing fluid flows from printing fluid supply channels 16 through ports 56, such as port 56 illustrated in FIG. 10, laterally into each ejection chamber 50 directly from printing fluid supply channels 16. An orifice plate 62 can be applied after molding body 14 to close printing fluid supply channels 16. In an example, a cover 80 can be formed over orifice plate (not shown) to close printing fluid supply channels 16. Cover can include a discrete cover partially defining printing fluid supply channels 16 and/or an integrated cover molded into body 14 can also be used.

As illustrated at 108, the method can include debonding a printhead flow structure from the flexible carrier 68 by flexing the flexible carrier at low temperature (e.g., temperatures at least 15° C. below a rated thermal release temperature of a thermal release tape), where the printhead flow structure includes the flex circuit 64 and the channel 16. Debonding can, in some examples, include flexing the flexible carrier 68 in at least a direction perpendicular to a bonding axis (e.g., represented by an axis 19 running parallel to a side of the flexible carrier 68 as illustrated in FIG. 5) sufficient to debond the printhead flow structure and return the flexible carrier 68 to its original shape when the printhead flow structure is debonded. As described herein, returning to an original shape refers to returning to substantially an original shape and position within a relatively short amount of time (e.g., under one second).

Flexible carrier can, in some examples, bend to debond a flex circuit below a temperature rated thermal release temperature. For example, debonding a flex circuit can occur at temperatures below 160 C.° from a flex carrier compared to a thermal release tape having a release temperature higher than 160 C.° (e.g., a thermal release tape rated has having a release temperature at 200 C.°). Debonding can occur in a range of from between 18° C. to 160° C. In some examples, debonding can occur at about ambient temperature (e.g., 21° C.), for example, debonding in a temperature range of from between 18° C. to 30° C. However, individual values and subranges from and including 18° C. to 30° C. are included; for instance, in some examples, for example, debonding can occur in a temperature range of from between 20° C.t 25° C.

In some examples, a process temperature to make the printhead flow structure does not exceed a temperature of 170° C. A process temperature refers to a temperature and/or temperatures during formation of the printhead flow structure 10, as described herein. For example, a process temperature can include a temperature(s) associated with each of the elements 102-108 as described with respect to FIG. 11 and/or otherwise detailed herein. Maintaining a process temperature of less than 170° C. can advantageously provide process simplification (e.g., a reduction in cycle time and/or stress) and/or energy savings (e.g., reduced operational costs), among other advantages. In some examples, a temperature associated with molding, for example, molding a channel in a molding as described herein, is maintained at least 40° C. below a release temperature of a thermal release tape used in the process. For example, molding can occur at a temperature below 129° C. for a thermal release tape having a release temperature of 170° C.

As used in this document, a "micro device" means a device having one or more exterior dimensions less than or equal to 30 mm; "thin" means a thickness less than or equal to 650 μm; a "sliver" means a thin micro device having a ratio of length to width (L/W) of at least three; a "printhead" and a "printhead die" mean that part of an inkjet printer or other inkjet type dispenser that dispenses fluid from one or more openings. A printhead includes one or more printhead dies. "Printhead" and "printhead die" are not limited to printing with ink and other printing fluids but also include inkjet type dispensing of other fluids and/or for uses other than printing.

The specification examples provide a description of the applications and use of the system and method of the present disclosure. Since many examples can be made without departing from the spirit and scope of the system and method of the present disclosure, this specification sets forth some of the many possible example configurations and implementations. With regard to the figures, the same part numbers designate the same or similar parts throughout the figures. The figures are not necessarily to scale. The relative size of some parts is exaggerated to more clearly illustrate the example shown.

What is claimed is:

1. A system, comprising:

a flexible carrier; and a printhead flow structure comprising:

a flex circuit including a carrier wafer, wherein the carrier wafer is bonded to the flexible carrier with thermal release tape, the thermal release tape to debond substantially completely from the flex circuit at a debonding temperature via bending of the flexible carrier; and at least one printhead die electrically coupled to the flex circuit.

2. The system of claim 1, wherein the flexible carrier includes an elastomer material.

3. The system of claim 1, wherein the printhead flow structure includes a plurality of printhead dies molded into an elongated, monolithic body.

4. The system of claim 1, wherein the flexible carrier includes a cured epoxy composition.

5. The system of claim 1, wherein the printhead die includes at least one electrical terminal coupled to the flex circuit.

6. The system of claim 1, wherein the printhead flow structure further comprises:

a molding forming at least one fluid supply channel fluidly coupled to the printhead die.

7. The system of claim 6, wherein the molding partially encapsulates the printhead die.

8. The system of claim 1, wherein the thermal release tape is to debond at a temperature in a range of from 18° Celsius (C.) to 160° C.

9. The system of claim 1, wherein the printhead die includes at least one port to allow fluid to flow from the fluid supply channel into the printhead die.

* * * * *